US011406875B2

(12) United States Patent
Bubyrenko

(10) Patent No.: US 11,406,875 B2
(45) Date of Patent: Aug. 9, 2022

(54) SPORTS APPARATUS

(71) Applicant: Vyacheslav Olegovich Bubyrenko, Moscow (RU)

(72) Inventor: Vyacheslav Olegovich Bubyrenko, Moscow (RU)

( * ) Notice: Subject to any disclaimer, the term of this patent is extended or adjusted under 35 U.S.C. 154(b) by 0 days.

(21) Appl. No.: 16/644,616

(22) PCT Filed: Sep. 5, 2018

(86) PCT No.: PCT/RU2018/000588
§ 371 (c)(1),
(2) Date: Mar. 5, 2020

(87) PCT Pub. No.: WO2019/050435
PCT Pub. Date: Mar. 14, 2019

(65) Prior Publication Data

US 2021/0060386 A1 Mar. 4, 2021

(30) Foreign Application Priority Data

Sep. 5, 2017 (RU) ..... RU2017131240
Dec. 27, 2017 (RU) ..... RU2017146295

(51) Int. Cl.
*A63B 26/00* (2006.01)
*A63B 21/00* (2006.01)
*A63B 21/06* (2006.01)

(52) U.S. Cl.
CPC ..... *A63B 26/003* (2013.01); *A63B 21/4033* (2015.10); *A63B 21/0602* (2013.01); *A63B 21/0603* (2013.01); *A63B 2225/62* (2013.01)

(58) Field of Classification Search
CPC ..... A63B 26/003; A63B 21/4033; A63B 21/0602; A63B 21/0603; A63B 2225/62;
(Continued)

(56) References Cited

U.S. PATENT DOCUMENTS 5,119,519 A * 6/1992 Foreman ..... A47G 9/1045 5/640
5,735,776 A 4/1998 Swezey et al.
(Continued)

FOREIGN PATENT DOCUMENTS

GB 2474062 A 4/2011

*Primary Examiner* — Andrew S Lo
*Assistant Examiner* — Andrew M Kobylarz
(74) *Attorney, Agent, or Firm* — Brooks Kushman P.C.

(57) ABSTRACT

The invention relates to sports apparatuses with unstable surface intended for improving and maintaining ones physical condition. The sports apparatus according to a first embodiment comprises a flexible shell formed as a hermetic chamber with a valve and having an inner space for filling with a filler material and/or air. The hermetic chamber is accommodated within a case with handles. Once the chamber inner space is filled with a filler material and/or air, the sports apparatus in fact forms a rectangular parallelepiped with rounded corners. Side faces of the apparatus form a closed surface. The side face has a height not exceeding a half of the apparatus length. A supporting portion of the apparatus and a portion that the user interacts with are arranged to be identical and outwardly convex. The sports apparatus in operating condition has an elliptical cross-section. Said sports apparatus portions are unstable surfaces.

20 Claims, 4 Drawing Sheets

(58) Field of Classification Search
CPC ..... A47G 2009/003; A47G 2009/008; A47G 9/1027; A47G 9/10
USPC ..... 5/709, 644
See application file for complete search history.

(56) References Cited

U.S. PATENT DOCUMENTS

| | | | | |
|---|---|---|---|---|
| 6,149,555 | A | 11/2000 | Kinback | |
| 6,283,811 | B1 | 9/2001 | Peterson | |
| 6,312,364 | B1 * | 11/2001 | Selsam | A63B 21/072 482/52 |
| 9,314,118 | B2 * | 4/2016 | Blazar | A47G 9/1027 |
| 2004/0082445 | A1 * | 4/2004 | Zabel | A63B 21/06 482/109 |
| 2006/0040803 | A1 * | 2/2006 | Perez | A63B 21/00069 482/121 |
| 2015/0273306 | A1 * | 10/2015 | Fu | A63B 23/12 482/87 |

* cited by examiner

SPORTS APPARATUS

CROSS-REFERENCE TO RELATED APPLICATIONS

The present patent application is a National stage of the PCT application PCT/RU2018/000588 filed on Sep. 5, 2018 which claims priority to Russian patent applications RU 2017131240 filed on Sep. 5, 2017, RU 2017146295 filed on Dec. 27, 2017, all of which incorporated herein by reference by their entirety.

FIELD OF THE INVENTION

The invention relates to sports apparatuses with unstable surface intended for improving and maintaining one's physical condition. The invention may be used in fitness training, performing physical exercises for improving one's coordination, strength and endurance. The sports apparatus may be also used in any fields of activity aimed at developing, improving and keeping in tonus one's muscles, including but not limited to physical rehabilitation, health-improving gymnastic exercises, developing and improving one's motor skills, in particular improving one's ability to keep balance and improving one's posture.

BACKGROUND OF THE INVENTION

Known in the art is equipment for performing exercises on unstable surface: fitballs, hemispheres and other unstable appliances. Exercises on unstable surface were first practiced in clinical setting, therapeutic physical training. It was found out as a result of scientific research that exercises on unstable surface help to restore one's sensory function owing to that the central nervous system receives more information to generate necessary motor impulses. However, the known apparatuses fail to meet in full the requirements of efficient and injury-free operation.

CN 202173736 (U) Mar. 28, 2012 discloses an elastic fitball provided with lug-shaped handles and foot rings. The fitball has a ball-shaped body. A drawback of the known solution is that the sports apparatus is ball-shaped so that it limits one's ability to perform exercises, for example, in the standing position on the fitball due to the risk of injury. The fitball is hollow, which lowers the training efficiency because it is solely the apparatus shape that adds instability to the same.

These drawbacks are in part avoided in RU 2581813 (C2, Apr. 20, 2016) chosen by the applicant as the closest prior art. The device for improving one's physical condition comprises a specially selected shell filled with a filler material. The shell may be filled or emptied while training is performed (directly on the spot). The shell has no ribbons or handles on its outside surface. The shell is sized so as to match the user's breadth of shoulders. The shell contour, at least when viewed from the front, is shaped as a lemniscate with a longitudinal axis serving as an axis of symmetry and with two separate portions of a maximum width arranged at right angle to the longitudinal axis (RU patent No. 2581813 C2, Apr. 20, 2016).

A drawback of this device is its shape because in case of partial loading, the filler material may accumulate in one of the two extreme portions to result in unbalanced load. The absence of handles limits performing some exercises, in particular various kinds of manipulations with the device aloft. These drawbacks make the known solution less efficient because the possibility of performing training exercises, especially during medical and physical rehabilitation is limited thereby.

SUMMARY

It is an object of the present invention to provide a sports apparatus whose instability is enabled both by its shape and a filler material comprising a liquid or solids able to readily migrate within the apparatus, wherein the apparatus is efficient and injury-free for performing training exercises by different groups of users. As a result of solving said problem, there is achieved a technical effect consisting in providing a sports apparatus with unstable surface, wherein the apparatus weight may be changed simultaneously with adjusting its elasticity, allowing in turn aerobic, anaerobic and static load to be applied to the user's muscles and hence the training efficiency to be improved.

In addition, the claimed invention allows the range of technical means having this purpose to be enlarged.

Said technical effect is achieved by means of the structure of the sports apparatus.

The sports apparatus according to a first embodiment comprises a flexible shell formed as a hermetic chamber with a valve and having an inner space for filling with a filler material and/or air. The hermetic chamber is accommodated within a case with handles. Once the chamber inner space is filled with the filler material and/or air, the sports apparatus in fact forms a rectangular parallelepiped with rounded corners. Side faces of the apparatus form a closed surface. The side face has a height not exceeding a half of the apparatus length. A supporting portion of the apparatus and a portion that the user interacts with are arranged to be identical and outwardly convex. The sports apparatus in operating condition has an elliptical cross-section. Said sports apparatus portions are unstable surfaces. The hermetic chamber valve is operative to adjust the air pressure within the chamber.

The case is made of a strong non-slip fabric.

The hermetic chamber is made of a polymeric material.

The filler material comprises a material able to migrate readily within the chamber.

Handles are arranged on a side face of sports apparatus case.

A hole to access the hermetic chamber valve and a valve for removing the chamber from the case are arranged on a side face of sports apparatus case.

A second embodiment differs in that the apparatus is not provided with the case. Handles are formed integrally with the elastic chamber.

Being flexible and filled with the filler material and/or pressurized air in combination with its shape, the hermetic chamber allows the apparatus surface to be made unstable. Unstable surface should be understood as an unsteady and variable surface. The unstable surface is dynamically provided by the filler material (when used in the apparatus) and is statically provided by air. The filler material allows the apparatus weight to be changed (by using more or less filler material) and it elasticity to be adjusted by varying the air pressure via the valve in the hermetic chamber. Handles allow the sports apparatus to be safely held and various manipulations with the same to be performed aloft. The proposed sports apparatus allows physical load to be distributed among different groups of the user's muscles, the range of exercises being performed to be considerable enlarged and the training efficiency to be improved thereby. According to the results of tests performed, the apparatus shape has shown to be most efficient compared to other apparatuses with unstable surface. Worthy of note is also the convenience of using the apparatus and the safety of performing exercises owing to a supporting surface, low height of the apparatus and the presence of handles.

BRIEF DESCRIPTION OF THE DRAWINGS

The claimed invention will be illustrated by the drawings.

DETAILED DESCRIPTION OF THE PREFERRED EMBODIMENT

The sports apparatus comprises a flexible shell with an inner space, said shell being shaped as a rectangular parallelepiped with rounded corners. The sports apparatus in operating condition after filling the same with a filler material or air has an elliptical cross-section with the proviso that that it resembles an ellipse while the shape of the end product may not be elliptical according to the definition of this term.

Figure 1:
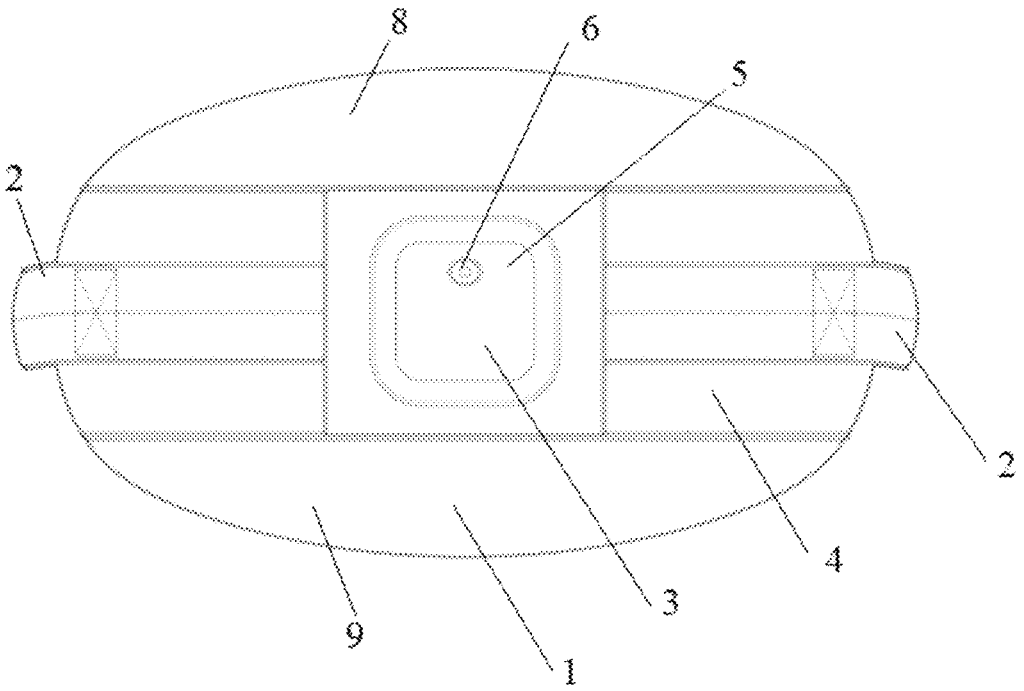
FIG. 1 is a side view of the sports apparatus from the side where a hole is provided in the case (embodiment 1).
Figure 2:
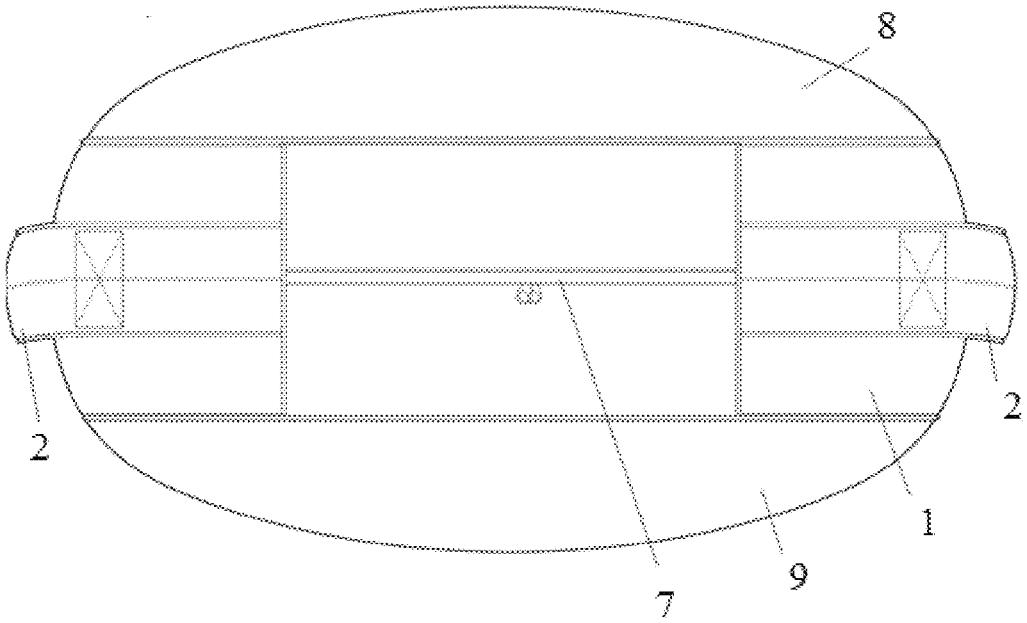
FIG. 2 is a side view of the sports apparatus from the side where a valve is provided in the case (embodiment 1).
Figure 3:
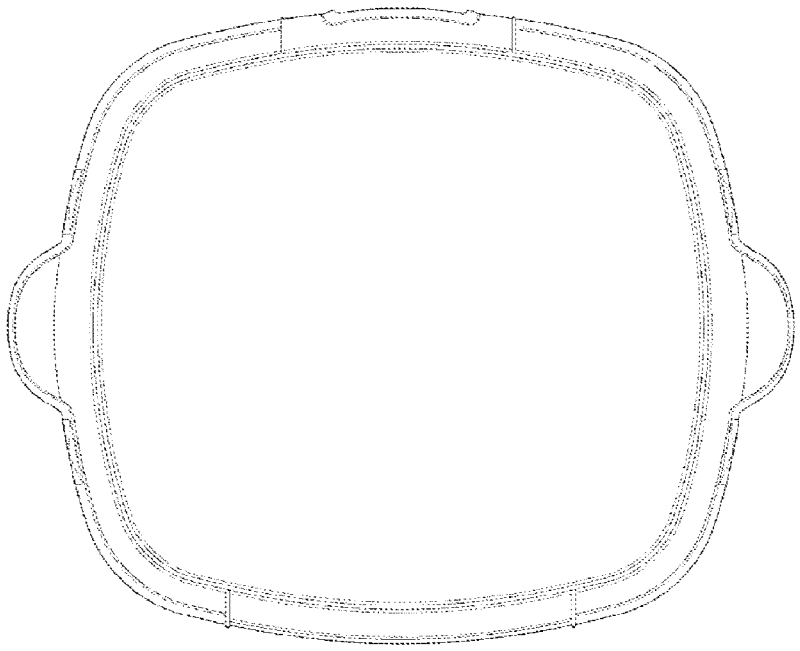
FIG. 3 is a view of the sports apparatus illustrating one of unstable surfaces thereof (embodiment 1).

The sports apparatus according to the first embodiment (FIGS. 1-3) consists of a case 1 with handles 2 and a hermetic chamber 3 accommodated inside for filling with a filler material or air. The case 1 is made of a strong non-slip fabric. The handles 2 are arranged coaxially at the opposite ends on the side face 4 of the case 1. The case handles 2 are made of a textile ribbon strap, tape or other strong material. There is a hole 5 providing free access to the chamber 3 valve 6 and a valve 7 also coaxially arranged at the opposite ends on the side face 4. Said axes extend perpendicularly to each other and intersect at the center of the sports apparatus shaped as a pillow. Said hole 5 may also be provided with a valve. Said valve 7 is adapted for closing with a zip fastener, Velcro fastener, snap fasteners or other fastener means. The valve 7 is operable for removing (placing) the chamber 3 from (to) the case.

The sports apparatus has identical outwardly convex supporting surfaces 8 and 9. The supporting surfaces 8, 9 may be conventionally termed as a lower surface and an upper surface. When in use, the lower surface of the sports apparatus will be the one lying on or facing the floor and the upper surface will be the one supporting the user's arm, leg or other part of the user's body.

The supporting surface 8 (9) has a length (L) substantially equal to the apparatus width (B). For achieving a maximum effect, the apparatus length (L) is selected according to the user's breadth of shoulders otherwise the exercises will be inefficient. Various sizes of the apparatus are possible suitable for men, women and children.

The apparatus side faces 4 form a surface close on four sides. It is also important for achieving the technical effect that the side face has a height (h) not exceeding a half of the supporting surface length (L) (see FIG. 4). The side faces 4 forming a surface close around the perimeter prevent the apparatus from being inflated into a sphere. It should be obvious to a skilled person that an insignificant difference between the values of the supporting and side surfaces measured in actual operation is not of principle and production tolerances are admissible.

The chamber 3 is made of a flexible material, preferably a polymeric material, for example, PVC plastisol and comprises an unstable surface.

Figure 4:
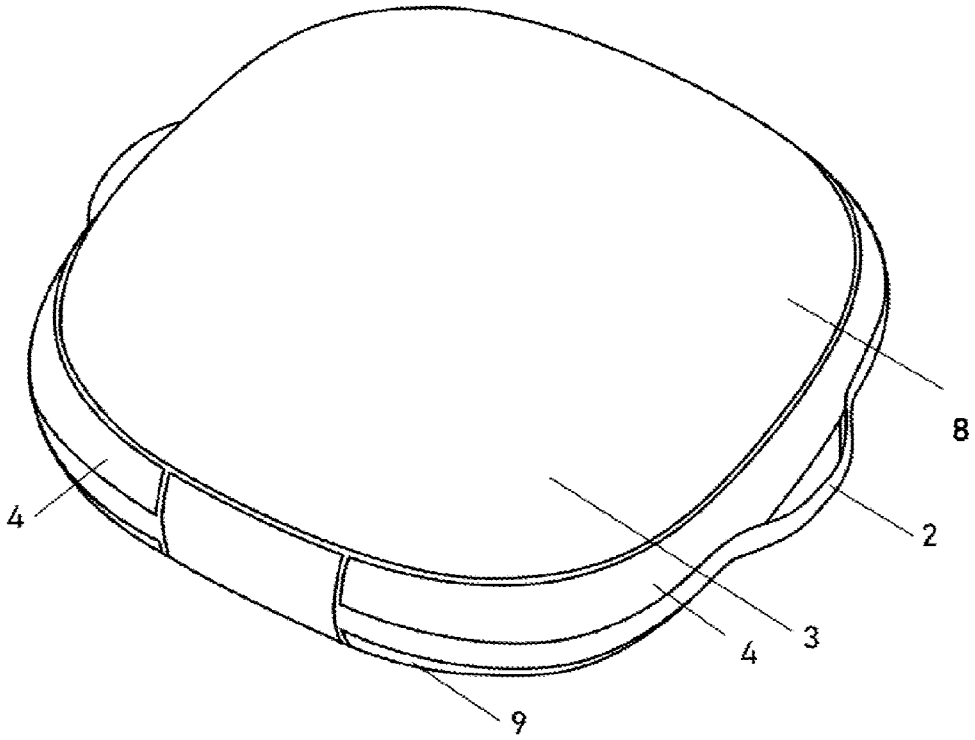
FIGS. 4, 5 and 6 show the sports apparatus without a case (embodiment 2).
Figure 5:
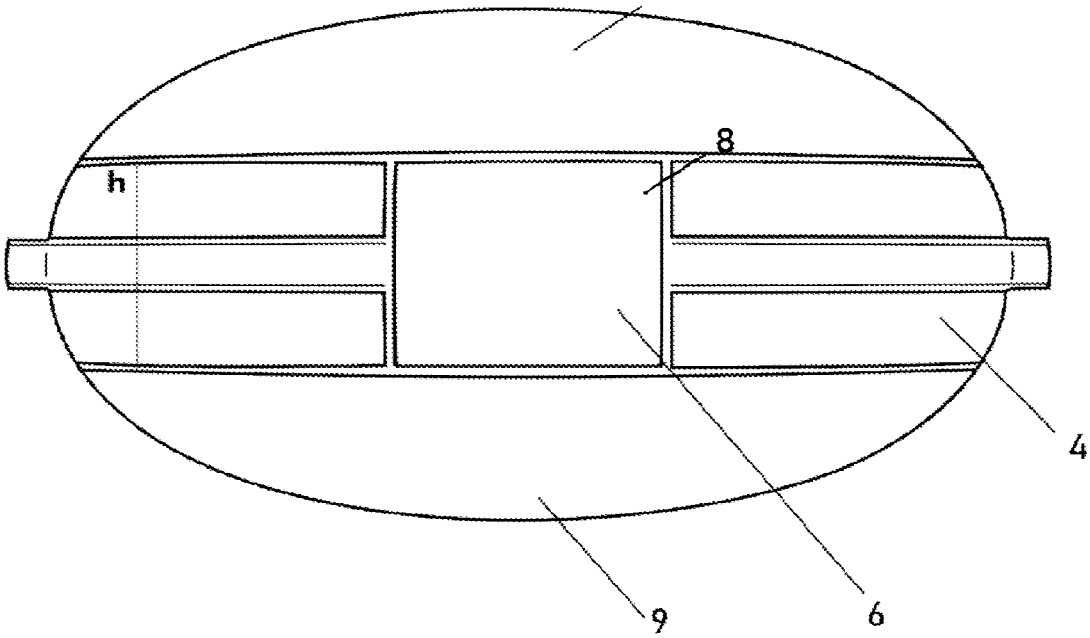
Figure 6:
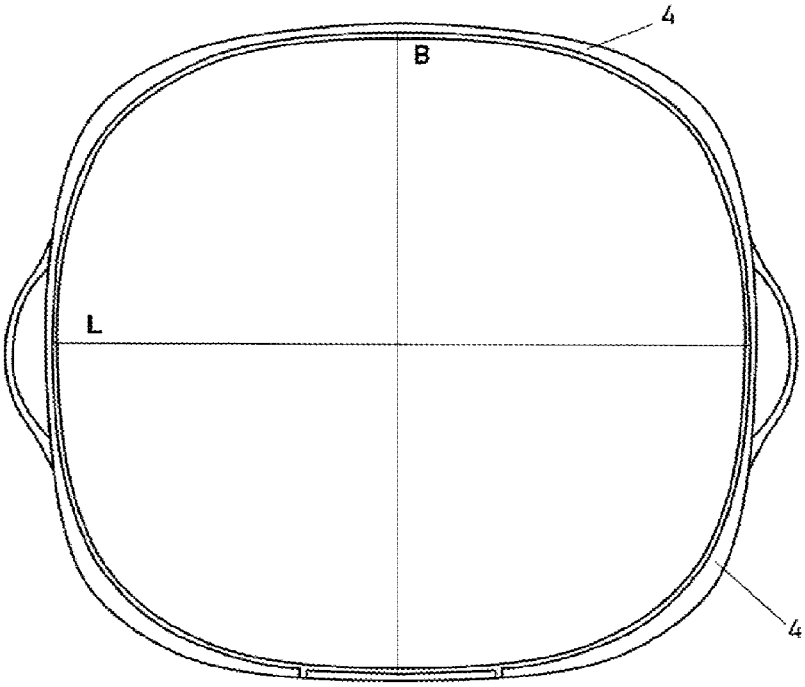

The sports apparatus is advantageously provided with the case. The chamber is thereby readily formed without handles which are sewn to the case easily replaceable as appropriate. In addition, the case protects the chamber against being pierced accidentally. The case may be made of a strong fabric of any color and provided with personal initials, manufacturer's logo. However, a second embodiment of the sports apparatus having no case may be also provided (FIGS. 4, 5). In this case, the hermetic chamber 3 is formed integrally with the handles 2. The sports apparatus also has the valve 6 for filling the chamber with the filler material.

Water is the simplest available filler material. Other substance and materials, for example, sand, liquid gels, hydrogel-containing beads, polymeric granules and other liquid and solid materials able to readily migrate within the chamber may be used as filler material.

The apparatus may be filled only with air (without the filler material) but the training efficiency using such apparatus will be considerably lower for the reasons discussed below.

In order to put the sports apparatus into operation, the chamber 3 valve 6 is opened, the filler material, for example, water is filled in through the hole, and air is injected by a pump. Then the valve 6 is closed tightly. The sports apparatus is ready for use.

The extent of filling the chamber with the filler material is dependent on the user's physical fitness. It has been found out empirically that to achieve a maximum training effect using the proposed sports apparatus, the chamber should be filled by not more than 81% of its total volume and by not less that 9%. If the amount of the filler material within the shell is less or more than said values, the training efficiency becomes lower.

The proposed sports apparatus may be used to perform exercises while standing, sitting or lying thereon. In addition, using the handles 2, the user may perform manipulations with the sports apparatus aloft. In the process of using the proposed sports apparatus (the user may hold the same in front of or above him/herself or while leaning on such sports apparatus), the filler material migrates inside the apparatus so that the user has to apply additional efforts to balance the same and also to perform an exercise with the same, which in turn results in additional calories being burnt compared to the apparatuses having no variable center of gravity (such as dumbbells, weights, barbells, putting stones, etc.). When using an apparatus formed as unstable surface (when the user leans his/her legs, arms or other parts of the body on the same), one needs to keep balance continuously, which in turn results in more calories than usually being burnt when performing exercises. Combining the above modes of using the apparatus as well as fast switching between such modes are also characteristic features of the apparatus. Almost all body muscles are actively involved in the process.

Owing to the filler material and air within the chamber 3, the sports apparatus may be used as a weight with a variable center of gravity when performing manipulations aloft.

The apparatus weight is adjusted by adding more filler material to or removing part of the filler material from the chamber, wherein it is also possible to vary the chamber pressure depending on the training purpose.

The sports apparatus without the filler material has a weight of 2 to 2.5 kg while its weight with the filler material may reach 10 kg.

Figure 7:
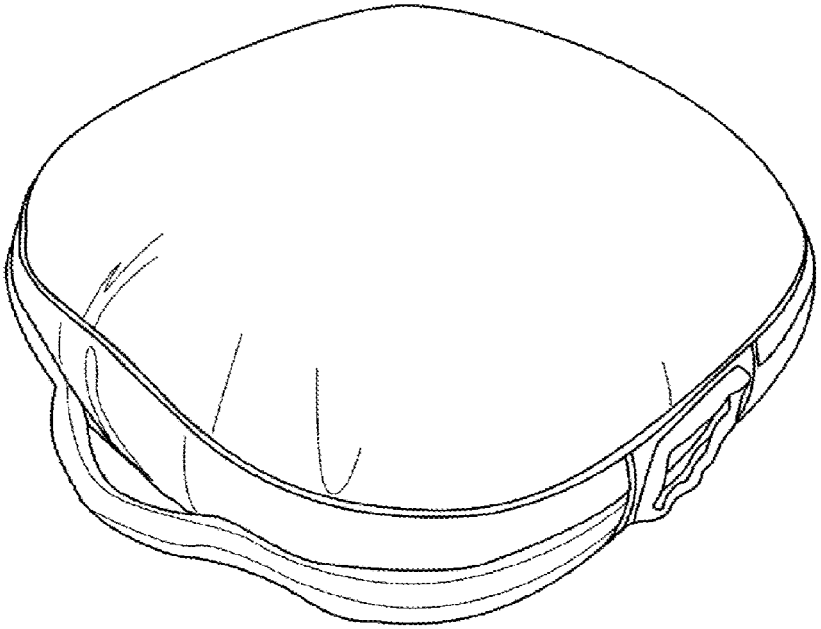
FIG. 7 is a photograph of the end product according to the first embodiment.

Carrying out the invention is illustrated by a particular example shown in FIG. 7. An apparatus for rehabilitation was manufactured by the inventor with a case of 50 cm in width according to the breadth of shoulders and of 50 cm in length. The side face of the apparatus had a height of 25 cm. As a filler material, 3,500 ml of water was used, accounting for 32% of its total volume and air injected by a pump through the valve 6. Once the chamber was filled with the air, the apparatus took the shape of an ellipse so that the supporting surfaces 8 and 9 became convex (radial). The side faces 4 forming a surface closed around the perimeter prevent the apparatus from being inflated into a sphere. Water used as the filler material increased the weight of the apparatus to 5.5 kg and made the same more unstable.

The proposed technical solution makes it possible to perform exercises of a low and medium intensity, i.e. aerobic loads where oxygen is the only and sufficient source of energy, anaerobic loads my means of lifting the apparatus, (power) exercises where no oxygen is involved in energy production and energy is produced on account of a "ready-to-use fuel" store contained directly in the muscles, as well static exercises performed in the static (motionless) position where such load provides a maximum load-applying effect. The user may stand on the apparatus, lean his/her knees thereon or lie in a prone position keeping the body balance on the unstable surface, perform exercises with the apparatus aloft.

Therefore, the structure of the claimed sports apparatus makes it possible to apply loads to different groups of the user's muscles, to enlarge considerably the range of exercises being performed and their alternation, wherein exercises performed using the apparatus are safe and available for different groups of users. The invention enlarges the range of sports apparatuses with unstable surface.

What is claimed is:

1. An exercise device comprising:

a flexible shell formed as a hermetic chamber having a hermetic chamber valve for filling an inner space of the hermetic chamber at least partially with a filler material and air to adjust a pressure within the hermetic chamber;

a case having a closed surface, wherein the flexible shell is disposed within the case and once the hermetic chamber's inner space is filled with the filler material and air to an operating condition, the closed surface forms a rectangular parallelepiped with rounded corners, wherein side faces of the closed surface have a height less than one half of a length of a side face, wherein handles extend from at least two opposite side faces of the case, wherein when the flexible shell is filled to the operating condition, the hermetic chamber expands to define support surfaces both extending outwardly convex from the closed surface such that a cross-section through the upper and lower support surfaces and the closed surface is an elliptical cross-section.

2. The exercise device according to claim 1, wherein the case is made of a strong non-slip fabric.

3. The exercise device according to claim 1, wherein the hermetic chamber is made of a polymeric material.

4. The exercise device according to claim 1, wherein the filler material comprises a liquid or a solid material able to migrate readily within the chamber.

5. The exercise device according to claim 1, wherein the handles are arranged on the at least two opposite side faces of the case of the exercise device.

6. The exercise device according to claim 1, wherein a hole to access the hermetic chamber valve and a valve for removing the hermetic chamber from the case are arranged on at least two opposite side faces of the case of the sports exercise device.

7. The exercise device according to claim 1, wherein the hermetic chamber is filled to between 9% and 81% of the inner space volume to define the support surfaces as unstable.

8. The exercise device according to of claim 1, wherein the handles comprise at least two handles to manipulate a position of the user relative to the exercise device.

9. The exercise device according to claim 1, wherein the inner space of the hermetic chamber is open to allow the filler material to migrate as the user performs an exercise with the exercise device, the exercise device thereby having a variable center of gravity.

10. The exercise device according to claim 1, wherein the exercise device has an unfilled weight of 2-2.5 kg.

11. The exercise device according to claim 1, wherein the exercise device has a filled weight of up to 10 kg when the hermetic chamber is filled with the filler material and air.

12. An exercise device comprising:

a flexible shell, the flexible shell formed as a hermetic chamber with a hermetic chamber valve for filling the hermetic chamber with filler material and pressurized air, wherein the flexible shell has a closed surface positioned at an intermediate position of the flexible shell, the closed surface having a shape of a rectangular parallelepiped with rounded corners when the hermetic chamber is filled;

wherein side faces of the closed surface having a height not exceeding one half of a length of a side face;

wherein when the hermetic chamber is filled, upper and lower support surfaces extend from the closed surface and are arranged to be identical and outwardly convex, wherein in operating condition the exercise device has an elliptical cross-section extending through the upper and lower support surfaces and the closed surface, wherein the upper and lower support surfaces that a user interacts with are unstable surfaces, wherein the inner space of hermetic chamber is open to allow the filler material to migrate as the user exercises with the exercise device, the exercise device thereby having a variable center of gravity.

13. The exercise device according to claim 12, wherein the filler material comprises a material able to migrate readily within the chamber.

14. The exercise device according to claim 12, wherein the hermetic chamber is made of a polymeric material.

15. The exercise device according to claim 12, wherein handles are formed integrally with the hermetic chamber.

16. An exercise device, comprising:

a flexible shell formed as a hermetic chamber having a hermetic chamber valve for filling the hermetic chamber at least partially with a filler material and air and adjusting a pressure within the hermetic chamber; and a closed surface forming a rectangular parallelepiped with rounded corners and positioned at an intermediate position of the flexible shell, wherein side faces of the closed surface have a height less than one half of a length of a side face;

wherein when the flexible shell is filled to the operating condition, the hermetic chamber expands to define an upper support surface extending above the closed surface and a lower support surface extending below the closed surface, the upper and lower support both extending outwardly convex in a mirror image from the closed surface such that a cross-section through the upper and lower support surfaces and the closed surface is an elliptical cross-section, wherein the hermetic chamber is filled to between 9% and 81% of a total volume of the hermetic chamber to define the upper and lower support surfaces as unstable, wherein the hermetic chamber defines an open inside space that allows the filler material to move inside the apparatus as a user performs an exercise with the exercise device and thereby have a variable center of gravity as the filler material moves.

17. The exercise device according to claim 16, wherein the filler material comprises a liquid or a solid material able to migrate readily within the chamber.

18. The exercise device according to claim 17, wherein the filler material comprises water.

19. The exercise device according to claim 16, further comprising at least two handles extending from opposite side surfaces of the closed surface.

20. The exercise device according to claim 16, wherein handles are formed integrally with the hermetic chamber.

* * * * *